US012595609B2

(12) United States Patent
Domagalski et al.

(10) Patent No.: US 12,595,609 B2
(45) Date of Patent: Apr. 7, 2026

(54) DOMESTIC APPLIANCES AND METHODS OF AUTOMATIC CALIBRATION

(71) Applicant: Haier US Appliance Solutions, Inc., Wilmington, DE (US)

(72) Inventors: Nathan Domagalski, Louisville, KY (US); Jose Efren Rodriguez Munoz, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 379 days.

(21) Appl. No.: 18/158,902

(22) Filed: Jan. 24, 2023

(65) Prior Publication Data

US 2024/0247421 A1 Jul. 25, 2024

(51) Int. Cl.

| | |
|---|---|
| ***D06F 33/30*** | (2020.01) |
| *D06F 101/20* | (2020.01) |
| *D06F 105/54* | (2020.01) |

(52) U.S. Cl.

CPC ..... *D06F 33/30* (2020.02); *D06F 2101/20* (2020.02); *D06F 2105/54* (2020.02)

(58) Field of Classification Search

CPC ..... D06F 33/00; D06F 33/30; D06F 33/47; D06F 35/00; D06F 39/001; D06F 39/088; D06F 2101/00; D06F 2101/20; D06F 2103/14; D06F 2103/16; D06F 2103/68; D06F 2105/00; D06F 2105/04; D06F 2105/54

See application file for complete search history.

(56) References Cited

U.S. PATENT DOCUMENTS

| | | | | |
|---|---|---|---|---|
| 6,523,370 | B1 * | 2/2003 | Broker | D06F 33/32 137/551 |
| 8,056,171 | B2 | 11/2011 | Zambrowicz et al. | |
| 10,106,924 | B2 | 10/2018 | Cruickshank et al. | |
| 2002/0099503 | A1 * | 7/2002 | Mishra | G08B 13/1418 701/469 |
| 2002/0116959 | A1 * | 8/2002 | Ohta | D06F 34/32 68/12.27 |

(Continued)

FOREIGN PATENT DOCUMENTS

| | | |
|---|---|---|
| CN | 102548892 B | 1/2015 |
| CN | 105177922 B | 8/2018 |

(Continued)

OTHER PUBLICATIONS

Machine Translation of Peebles, DE-102011084267-A1, Apr. 2013. (Year: 2013).*

*Primary Examiner* — David G Cormier
(74) *Attorney, Agent, or Firm* — Dority & Manning, P.A.

(57) ABSTRACT

A domestic appliance or method of operating a domestic appliance may include receiving power from an unpowered state. The method may also include determining an appliance relocation in response to receiving power from the unpowered state. The method may further include directing a calibration routine based on determining the appliance relocation. The calibration routine may include opening a water valve and closing the water valve according to a predetermined valve sequence or activating a motor mounted within a cabinet of the domestic appliance according to a predetermined motor sequence.

10 Claims, 4 Drawing Sheets

(56) References Cited

U.S. PATENT DOCUMENTS

| | | | | |
|---|---|---|---|---|
| 2010/0007907 | A1* | 1/2010 | Aikens | G06F 3/1238 358/1.14 |
| 2012/0096716 | A1* | 4/2012 | Tran | F28D 20/023 29/897.3 |
| 2013/0055770 | A1 | 3/2013 | Kim et al. | |
| 2019/0120725 | A1* | 4/2019 | Yoon | D06F 37/12 |
| 2019/0309460 | A1* | 10/2019 | Yoon | G05B 13/026 |
| 2022/0136160 | A1 | 5/2022 | Lee et al. | |

FOREIGN PATENT DOCUMENTS

| | | | | |
|---|---|---|---|---|
| DE | 102011084267 | A1 * | 4/2013 | D06F 39/001 |
| EP | 2591159 | B1 | 9/2020 | |

* cited by examiner

DOMESTIC APPLIANCES AND METHODS OF AUTOMATIC CALIBRATION

FIELD OF THE INVENTION

The present subject matter relates generally to domestic consumer appliances and, more particularly, to features and methods for calibrating domestic appliances.

BACKGROUND OF THE INVENTION

Domestic (e.g., household) appliances are used generally for a variety of tasks by a variety of users. For example, a household may include such appliances as laundry appliances (e.g., a washing machine or dryer appliance), kitchen appliances (e.g., a refrigerator, a microwave, a coffee maker, etc.), along with room air conditioners and various other appliances.

Certain domestic appliances include a number of sub-assemblies having various actuatable elements, such as water valves or motors. Such assemblies may be configured to operate under certain assumptions regarding, for instance, water temperature to be received from a domestic water supply, orientation or support of the installed appliance, or available (e.g., water, electrical, or network) connections for the appliance. These assumptions can be especially important when executing various operations. As an example, a washing machine appliance may be programmed to execute a cleaning cycle that assumes certain water temperatures or flowrates are provided, that various packing materials have been removed, or that various sub-assemblies are able to operate. Even if an appliance is correctly assembled and tested at a manufacturing facility, there is no guarantee that the appliance will be appropriately shipped and installed. In order to ensure this is the case, specialized technicians or equipment may be required to execute and measure certain cycles of the appliance. This can be time-consuming, expensive, or prone to error, even for experienced technicians.

As a result, it would be useful to provide an appliance or method with features for verifying or adjusting certain conditions of the domestic appliance. In particular, it may be advantageous to provide an appliance or method that could set-up one or more sub-assemblies of the appliance in a manner that quickly or easily ensures the appliance is able to operate as intended.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a domestic appliance is provided. The method may include receiving power from an unpowered state. The method may also include determining an appliance relocation in response to receiving power from the unpowered state. The method may further include directing a calibration routine based on determining the appliance relocation. The calibration routine may include opening a water valve and closing the water valve according to a predetermined valve sequence or activating a motor mounted within a cabinet of the domestic appliance according to a predetermined motor sequence.

In another exemplary aspect of the present disclosure, a laundry appliance is provided. The laundry appliance may include a cabinet, a water valve, a motor, and a controller.

The cabinet may define a chamber for the receipt of articles. The water valve may be attached to the cabinet in fluid communication within the chamber to selectively flow liquid thereto. The motor may be mounted within the cabinet in mechanical communication with the chamber. The controller may be in operative communication with the water valve and the motor. The controller may be configured to initiate a calibration operation. The calibration operation may include receiving power from an unpowered state, determining an appliance relocation in response to receiving power from the unpowered state, and directing a calibration routine based on determining the appliance relocation. The calibration routine may include opening a water valve and closing the water valve according to a predetermined valve sequence or activating a motor mounted within a cabinet of the laundry appliance according to a predetermined motor sequence.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
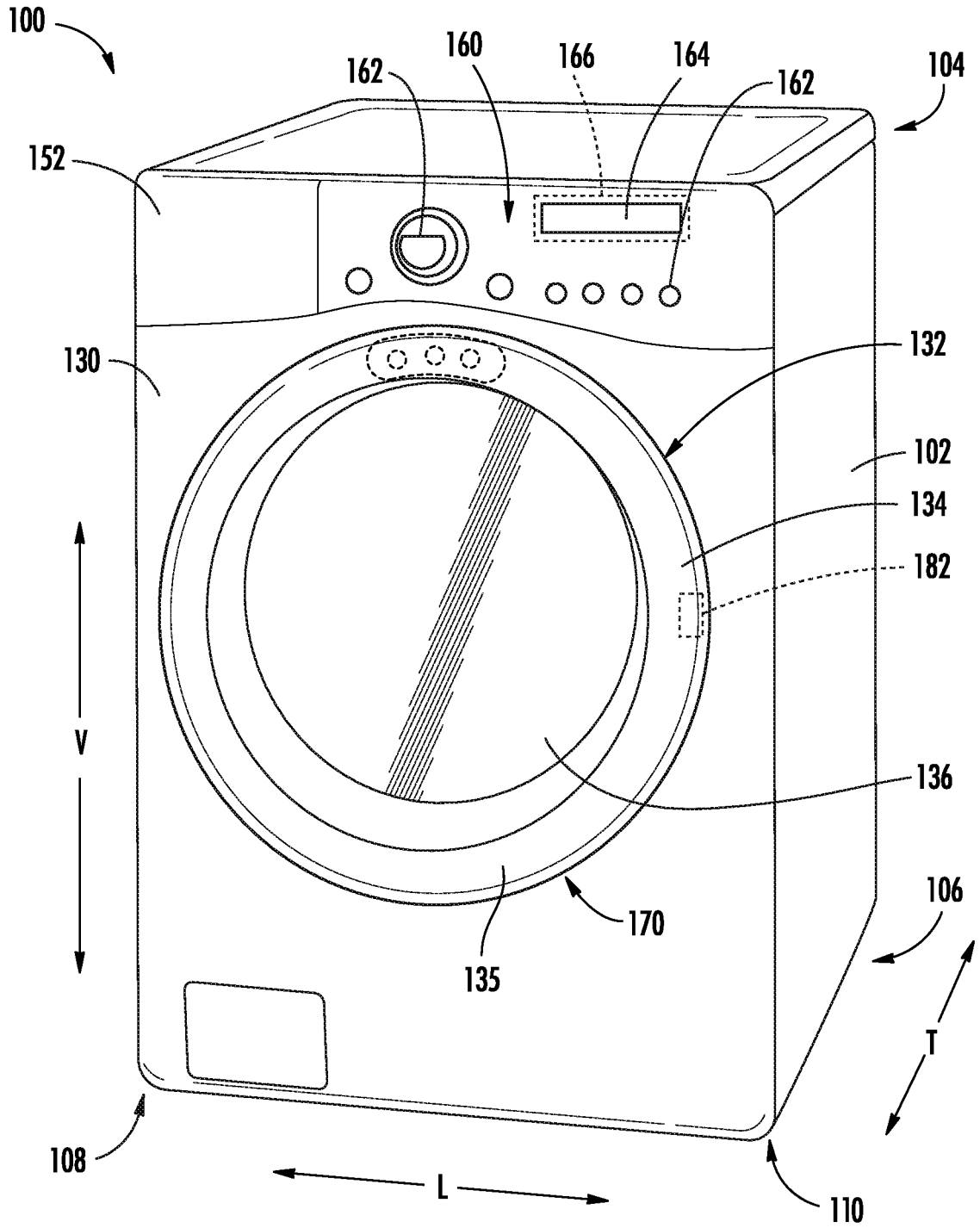
FIG. 1 provides a perspective view of a domestic appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Embodiments of the present disclosure provide a domestic appliance (e.g., laundry appliance), or method for operating the same, having a controller that is on or inside a cabinet and connects to one or more an electronic components (i.e., electrically controlled components), such as a water valve or motor. On initial startup or installation of the domestic appliance in a new location, the controller may automatically (e.g., without direct user input or instruction) determine that various electronic components should be calibrated in order to ensure the domestic appliance accounts for variations in environment, installation, or individual appliance units and operates as intended by the manufacture. Notably, the described embodiments may be performed or used without requiring direct user (e.g., consumer or technician) knowledge or specialized additional equipment.

Turning now generally to the figures, an exemplary domestic appliance is described. As will be understood by those skilled in the art in light of the present disclosure, a laundry appliance (e.g., washing machine appliance 100) is provided by way of example only, and the present subject matter may be used in any suitable domestic or household appliance, except as otherwise indicated or claimed. Thus, the present subject matter may be used with other laundry appliances (e.g., washing machine or dryer appliances) having different configurations. The present subject matter may further be used with other household appliances such as dishwasher appliances, refrigerator appliances, etc. Washing machine appliance 100 will be described below, with the understanding that other embodiments may include or be provided as another suitable domestic appliance (e.g., including a cabinet and a water valve or motor attached to the cabinet).

Figure 2:
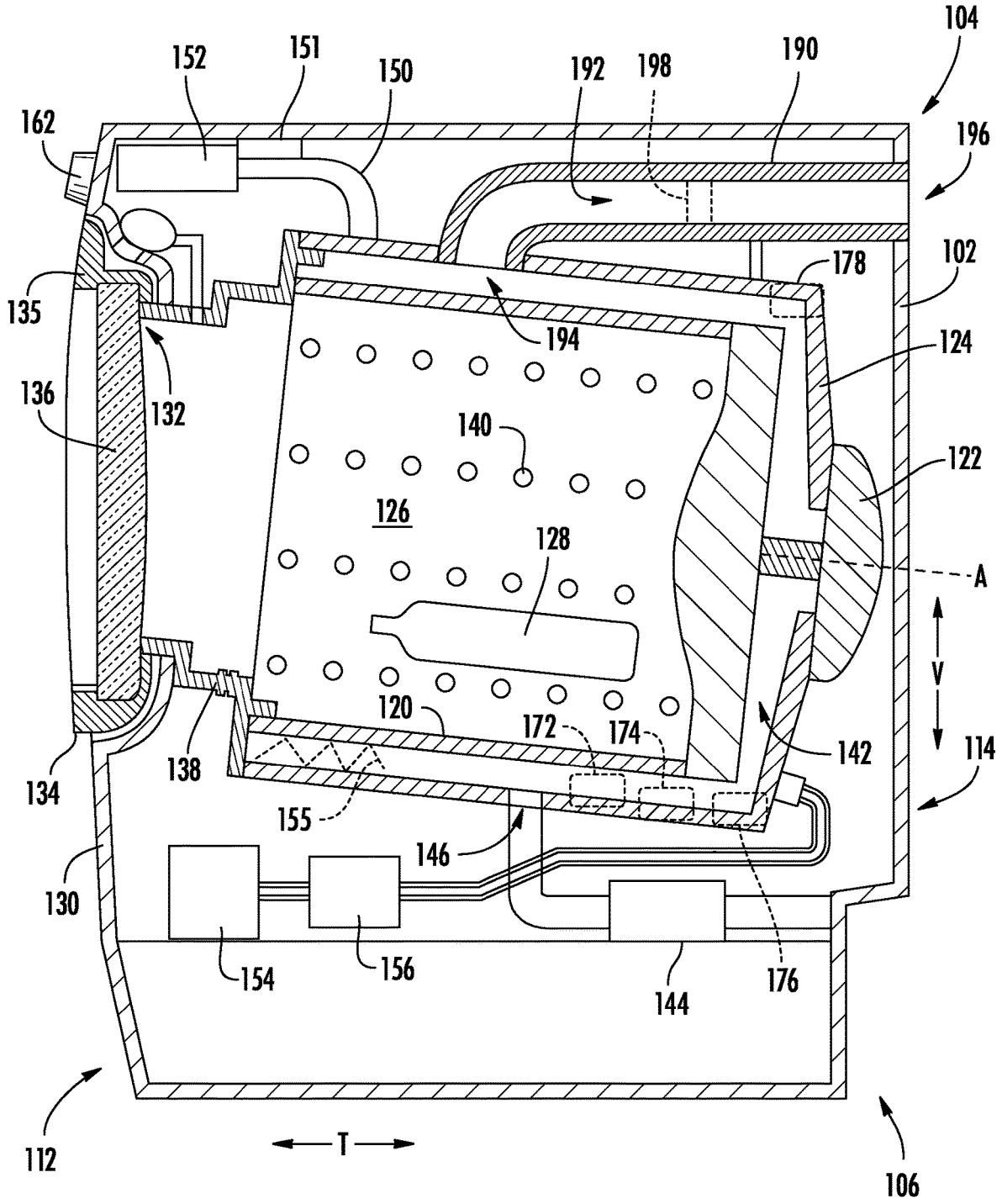
FIG. 2 provides a cross-sectional side view of the domestic appliance of FIG. 1.

Referring now specifically to FIGS. 1 and 2, an exemplary appliance will be described in accordance with exemplary aspects of the present subject matter. FIG. 1 provides a perspective view of an exemplary domestic washing machine appliance 100 and FIG. 2 provides a side cross-sectional view of appliance 100. As illustrated, appliance 100 generally defines a vertical direction V, a lateral direction L, and a transverse direction T, each of which is mutually perpendicular, such that an orthogonal coordinate system is generally defined.

Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

A wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102.

A wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiments, the axis of rotation A is substantially parallel (e.g., within 30°) relative to the transverse direction T. In this regard, washing machine appliance 100 is generally referred to as a "horizontal axis" or "front load" washing machine appliance 100. However, as noted above, the illustrated embodiments are provided merely as non-limiting examples and the present disclosure may be applicable to any other suitable laundry appliances, including "vertical axis" or "top load" washing machine appliances, as would be understood.

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation cycle, a rinse cycle, or a calibration routine of washing machine appliance 100). According to the illustrated embodiments, motor assembly 122 is a pancake motor. However, it should be appreciated that any suitable type, size, or configuration of motor may be used to rotate wash basket 120 according to alternative embodiments.

Cabinet 102 also includes a front panel 130 that defines an opening 132, which generally permits user access to wash basket 120 of wash tub 124. More specifically, washing machine appliance 100 includes a door 134 that is selectively positioned over opening 132 and is rotatably mounted to front panel 130 (e.g., about a door axis that is substantially parallel to the vertical direction V). In this manner, door 134 permits selective access to opening 132 by being movable between an open position facilitating access to a wash tub 124 and a closed position prohibiting access to wash tub 124. In exemplary embodiments, a lock assembly 182 is fixed to cabinet 102 to selectively lock or hold a free end of the door 134 to cabinet 102 when door 134 is in the closed position (e.g., during certain operations or wash cycles).

In some embodiments, a central body 136 of door 134 is provide on a perimeter rim 135 that extends about (e.g., radially about) at least a portion of central body 136. In optional embodiments, central body 136 is provided as a window and permits viewing of wash basket 120 when door 134 is in the closed position (e.g., during operation of washing machine appliance 100). Generally, door 134 defines a footprint 170 on a front portion of cabinet 102 (e.g., in a plane defined by the lateral direction L and the transverse direction T). For instance, when door 134 is in the closed position, central body 136 and perimeter rim 135 may extend across footprint 170 and thus cover the area of the front panel 130 within footprint 170 (e.g., when viewed along the transverse direction T directly in front of washing machine appliance 100). As shown, footprint 170 may extend radially outward from opening 132. Thus, footprint 170 may encompass and define a larger width (e.g., diameter) than opening 132. In some such embodiments, central body 136 extends across and, optionally, within opening 132. Perimeter rim 135 may extend radially outward from opening 132 and define the radial extrema of footprint 170.

In certain embodiments, central body 136 is provided as a non-permeable body, which blocks or prevents wash fluid or air from passing therethrough. In alternative embodiments, central body 136 defines one or more air aperture therethrough. Additionally or alternatively, door 134 may also include a handle (not shown) that, for example, a user may pull when opening 132 and closing door 134. Further, although door 134 is illustrated as mounted to front panel 130, it should be appreciated that door 134 may be mounted to another side of cabinet 102 or any other suitable support according to alternative embodiments.

A front gasket or baffle 138 may extend between tub 124 and the front panel 130 about the opening 132 covered by door 134, further sealing tub 124 from cabinet 102. For example, when door 134 is in the closed position, baffle 138 may contact central body 136 in sealing engagement therewith and within footprint 170.

As shown, wash basket 120 defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through plurality of perforations 140. A pump assembly 144 is located beneath wash tub 124 for gravity assisted flow when draining wash tub 124 (e.g., via a drain 146). Pump assembly 144 generally includes one or more pump motors or impellers (e.g., as would be understood), and may also be configured for recirculating wash fluid within wash tub 124.

In some embodiments, washing machine appliance 100 includes an additive dispenser or spout 150. For example, spout 150 may be in fluid communication with a water supply in order to direct fluid (e.g., clean water) into wash tub 124. For instance, one or more water valves 151 may be mounted or within cabinet 102 in fluid communication with a building water system to selectively open/close and thereby release/restrict water to the spout 150 or wash tub 124 generally. At least one valve 151 may, for instance, be connected to a hot water source (e.g., hot water heater appliance) as a "hot water valve." At least one other valve 151 may, for instance, be connected to an unheated water source (e.g., municipal water network or well) as a "cold water valve." Valves 151 may generally include or be provided as electronic (e.g., electrically controlled) valves and include a solenoid or corresponding valve motor to move a particular valve 151 between open and closed positions, as would be understood. Spout 150 may also be in fluid communication with the sump 142. For example, pump assembly 144 may direct wash fluid disposed in sump 142 to spout 150 in order to circulate wash fluid in wash tub 124.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during certain operations or wash cycle phases of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

In optional embodiments, a heating element 155 (e.g., resistive heating element) is mounted within the appliance 100. For instance, heating element 155 may be positioned inside, or otherwise in thermal communication with, wash tub 124. Optionally, heating element 155 may be mounted within a bottom portion (e.g., sump) of wash tub 124 beneath wash basket 120. Moreover, heating element 155 may be in operable communication (e.g., electrical communication or wireless communication) with a controller 166 (described below). In turn, controller 166 may selectively activate heating element 155, thereby generating or directing additional heat energy to a volume of liquid within wash tub 124.

In some embodiments, a control panel 160 including a plurality of input selectors 162 is coupled to front panel 130. Control panel 160 and input selectors 162 may collectively form a user interface input for operator selection of machine cycles and features. For example, in exemplary embodiments, a display 164 indicates selected features, a countdown timer, or other items of interest to machine users.

Operation of washing machine appliance 100 is generally controlled by a controller or processing device 166. In some embodiments, controller 166 is in operative communication with (e.g., electrically or wirelessly connected to) control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Generally, the storage or memory devices can store data and instructions (e.g., non-transitory programming instructions) that are executed by the processors to cause appliance 100 to perform operations. In certain embodiments, the instructions include a software package configured to operate appliance 100 (e.g., according to the exemplary method 400 described below with reference to FIG. 4). Additionally or alternatively, memory can store data (e.g., in one or more predefined slots) that can be obtained (e.g., received, accessed, written, manipulated, generated, created, stored, etc.) for further analysis of appliance performance, such as data received from the electronic components, sensor data, prerecorded data, or other data/information described herein.

In some embodiments, controller 166 includes a network interface 168 such that appliance 100 can connect to and communicate over one or more networks (e.g., a wide area network 300, such as the internet) with one or more network nodes, such as a remote server 312. As would be understood, connections to a larger network may be facilitated by connection to one or more intermediate networks, such as a local area network (e.g., intranet), low power wireless networks [e.g., Bluetooth Low Energy (BLE)], or some combination thereof and can include any number of wired or wireless links. Communication over networks via interface 168 can be carried via any type of wired or wireless connection, using a wide variety of communication protocols (e.g., TCP/IP, HTTP, SMTP, FTP), encodings or formats (e.g., HTML, XML), or protection schemes (e.g., VPN, secure HTTP, SSL). Optionally, network interface 168 may include or be provided as a global positioning system (GPS) receiver. Such a GPS receiver is generally configured for receiving transmissions from GPS satellites. As is understood, the GPS receiver can establish or determine a location of GPS receiver (and thus appliance 100) using such transmissions.

Figure 3:
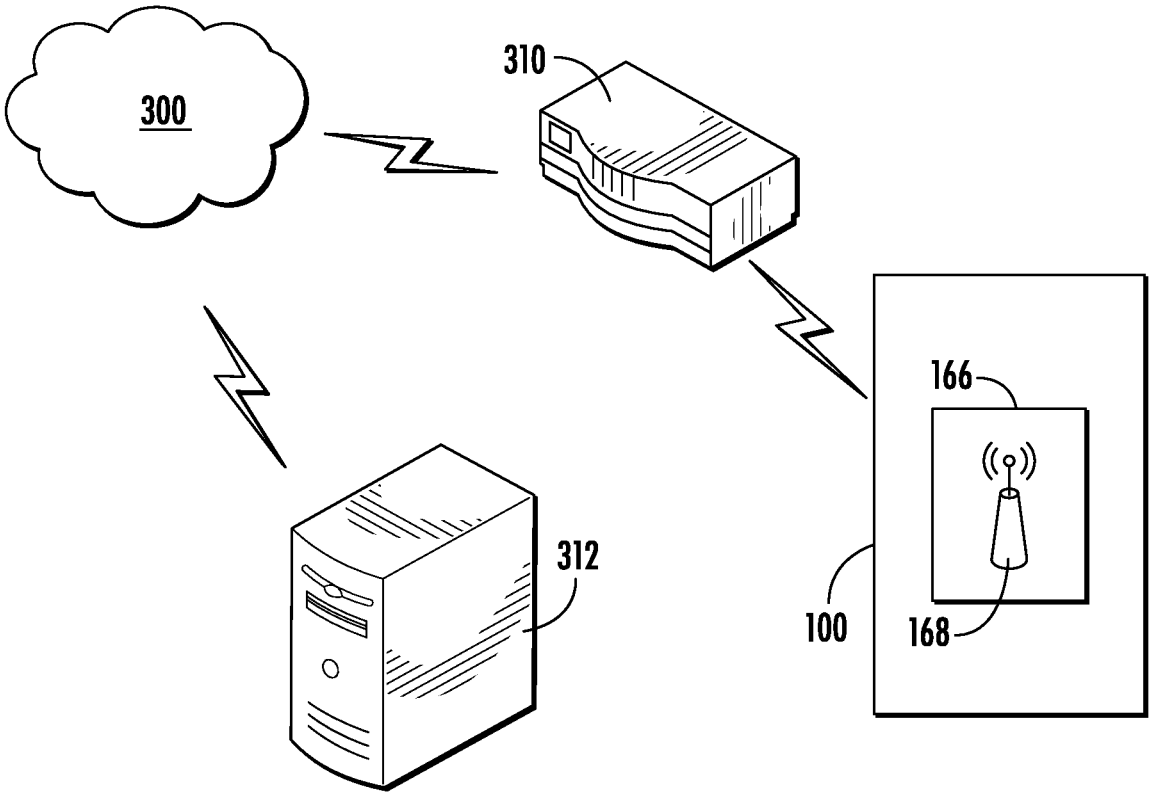
FIG. 3 provides a schematic view of a domestic appliance connected to a network in accordance with exemplary embodiments of the present disclosure.

In some embodiments, such as those illustrated in FIG. 3, the appliance 100 can access a wide area network 300 via an access point, such as a modem or router 310, which may be part of a local, wireless network (e.g., WI-FI® or wireless network having a frequency between 2.4 GHz and 6 GHz). As would be understood, such an access point may have a set identifier, such as an IP address. The access point may facilitate and store the name of an intermediate network (i.e., as a publicly visible network name). During installation, a user may thus be able to connect to the wide area network 300 or intermediate networks (e.g., to communicate with the remote server 312), as would be understood.

Returning to FIGS. 1 and 2, control panel 160 and other components of washing machine appliance 100, such as motor assembly 122, pump assembly 144, valves 151, heater element 155, or a fan 198 may be in operative communication with controller 166 via one or more signal lines or shared communication busses. Additionally or alternatively, other features, such as electronic lock assembly 182 for door 134 may be in operative communication with controller 166 via one or more other signal lines or shared communication busses.

In optional embodiments, one or more sensors are provided to detect or measure one or more conditions within or adjacent to appliance 100.

In certain embodiments, one or more temperature sensors 172 are included within cabinet 102. For instance, a temperature sensor 172 may be mounted on or within wash tub 124 (e.g., to detect a temperature of water to or within wash chamber 126). Temperature sensor 172 may be provided as any suitable temperature-detecting element (e.g., thermistor, thermocouple, etc.). Moreover, temperature sensor 172 may be in operable communication with (e.g., electrically connected to) controller 166. Thus, temperature sensor 172 may detect the temperature of water or wash fluid within wash chamber 126. Moreover, signals relating to the detected temperature may be communicated with controller 166.

In additional or alternative embodiments, one or more turbidity sensors 174 are included within cabinet 102. For instance, a turbidity sensor 174 may be mounted on or within wash tub 124 (e.g., to detect the effluent or total suspended solids in water within wash chamber 126). Turbidity sensor 174 may be provided as any suitable turbidity-detecting element (e.g., light emitter and light receiver configured to measure light reflected from the emitter). Moreover, turbidity sensor 174 may be in operable communication with (e.g., electrically connected to) controller 166. Thus, turbidity sensor 174 may detect the reflections of light from effluent in water or wash fluid within wash chamber. Moreover, signals relating to the detected reflections or effluent (e.g., turbidity) may be communicated with controller 166.

In further additional or alternative embodiments, a pressure sensor 176 is provided in operative communication with tub 124. For instance, pressure sensor 176 may communicate with the tub 124 through a sidewall thereof. Pressure sensor 176 may be configured to detect or measure pressure within the tub 124. In particular, pressure sensor 176 may detect or measure pressure generated by the liquid held within tub 124 (e.g., during a wash cycle). In some such embodiments, pressure signals detected at pressure sensor 176 may be transmitted to and received by controller 166. Controller 166 may be configured to determine the pressure within tub 124 (or the volume of liquid therein) based on the received pressure signals. As would be understood, pressure sensor 176 may be formed as any suitable pressure detecting device, such as a piezoresistive, capacitive, electromagnetic, piezoelectric, or optical pressure detecting device.

In yet further additional or alternative embodiments, one or more measurement devices 178 may be provided in the washing machine appliance 100 for measuring movement of the tub 124. For instance, a measurement device 178 in accordance with the present disclosure may include an accelerometer which measures translational motion, such as acceleration along one or more directions. Additionally or alternatively, a measurement device 178 may include a gyroscope, which measures rotational motion, such as rotational velocity about an axis. A measurement device 178 in accordance with the present disclosure is mounted to the tub 124 (e.g., a rear wall or a cylindrical sidewall thereof) to sense movement of the tub 124 relative to the cabinet 102 by measuring uniform periodic motion, non-uniform periodic motion, or excursions of the tub 124 during appliance 100 operation. During use, movement may be detected or measured as discrete identifiable components (e.g., in a predetermined plane or direction).

In exemplary embodiments, during operation of washing machine appliance 100 (e.g., following installation and calibration), laundry items are loaded into wash basket 120 through opening 132, and a wash cycle is initiated through operator manipulation of input selectors 162. For example, a wash cycle may be initiated such that wash tub 124 is filled with water, detergent, or other fluid additives (e.g., via spout 150 during a fill phase). One or more valves 151 can be controlled by washing machine appliance 100 to provide for filling wash basket 120 to the appropriate level for the amount of articles being washed or rinsed. By way of example, once wash basket 120 is properly filled with fluid, the contents of wash basket 120 can be agitated (e.g., with ribs 128) for an agitation phase of laundry items in wash basket 120. During the agitation phase, the basket 120 may be motivated about the axis of rotation A at a set speed (e.g., first speed or tumble speed). As the basket 120 is rotated, articles within the basket 120 may be lifted and permitted to drop therein.

After the agitation phase of the washing operation or wash cycle is completed, wash tub 124 can be drained (e.g., through a drain phase). Laundry articles can then be rinsed (e.g., through a rinse phase) by again adding fluid to wash tub 124, depending on the particulars of the wash cycle selected by a user. Ribs 128 may again provide agitation within wash basket 120. One or more spin phases may also be used. In particular, a spin phase may be applied after the wash cycle or after the rinse cycle in order to wring wash fluid from the articles being washed. During a spin phase, basket 120 is rotated at relatively high speeds. For instance, basket 120 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 120 increases its rotational velocity such that the plaster speed maintains the articles at a generally fixed position relative to basket 120.

After articles disposed in wash basket 120 are cleaned (or the wash cycle otherwise ends), a user can remove the articles from wash basket 120 (e.g., by opening door 134 and reaching into wash basket 120 through opening 132).

In some embodiments, a rear ventilation line 190 is provided within washing machine appliance 100. In particular, rear ventilation line 190 may be enclosed within cabinet 102. As shown in FIG. 2, exemplary embodiments include rear ventilation line 190 at a position in fluid communication between tub 124 and the surrounding region (e.g., the ambient environment outside of or immediately surrounding cabinet 102, the enclosed volume of cabinet 102 surrounding tub 124, etc.). Generally, it is understood that rear ventilation line 190 may be provided as any suitable pipe or conduit (e.g., having non-permeable wall) for directing air therethrough. When assembled, rear ventilation line 190 defines an air path (e.g., an output air path 192) from tub 124 and within or through cabinet 102 (e.g., to the ambient environment outside of cabinet 102). Specifically, output air path 192 extends from a ventilation inlet 194, through cabinet 102, and to a ventilation outlet 196. In some embodiments, ventilation inlet 194 is defined through a top portion of wash tub 124 and ventilation outlet 196 is defined through an upper portion of cabinet 102. Thus, output air path 192 may extend from the top portion of tub 124 to an upper portion of cabinet 102. Optionally, ventilation inlet 194 may be positioned below ventilation outlet 196 along a vertical direction V. Notably, a convective airflow may be naturally motivated from wash tub 124, through output air path 192, and to the ambient environment. Additionally or alternatively, splashing of wash fluid and the collection of moisture within output air path 192 may be prevented. However, any other suitable configuration may be provided to facilitate the flow of air from tub 124 and, for example, to the ambient environment.

Although a convective airflow may be facilitated, optional embodiments further include a fan or blower 198 (indicated in phantom lines). Specifically, fan 198 may be provided in fluid communication with rear ventilation line 190 to motivate an active airflow therethrough. For instance, fan 198 may be mounted within rear ventilation line 190 to selectively rotate and draw air from wash tub 124, through ventilation inlet 194, and to ventilation outlet 196 (e.g., to output an airflow from tub 124 to the ambient environment).

Figure 4:
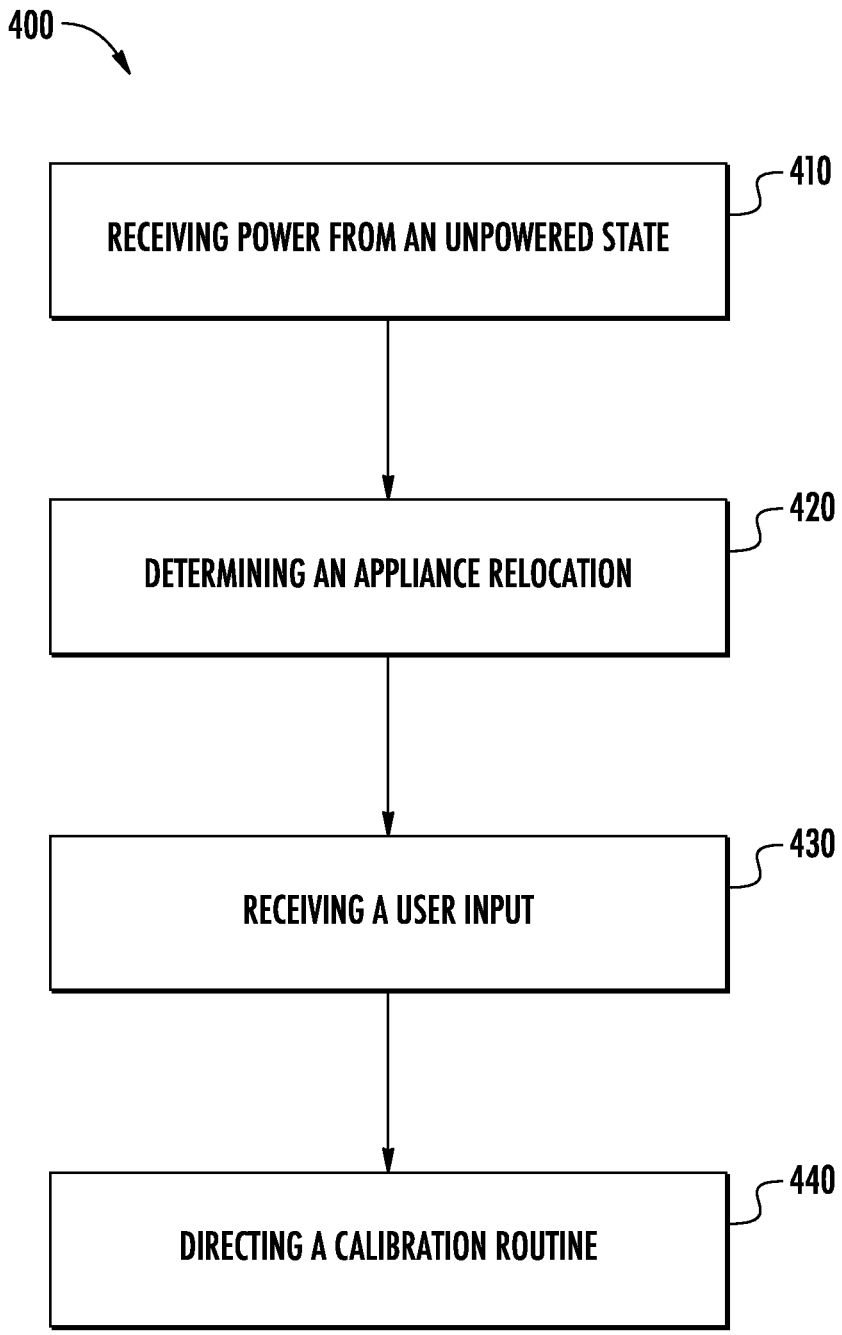
FIG. 4 provides a flow chart illustrating a method of testing a washing machine appliance according to exemplary embodiments of the present disclosure.

Referring now to FIG. 4, various methods (e.g., method 400) may be provided for use with a domestic appliance (e.g., appliance 100) or system in accordance with the present disclosure. In some embodiments, all or some of the various steps of the illustrated methods may be performed by one or more controllers (e.g., controller 166) as part of an operation that such controller(s) are configured to initiate for an appliance (e.g., a startup or calibration operation for appliance 100 that is executed independently of a regular wash or dry operation of the appliance). Advantageously, the below described methods may provide a quick or easy set-up of a new or newly installed appliance. Additionally or alternatively, a user or relatively untrained technician may initiate or start such methods (e.g., without having to wait for an experienced technician to be available in person).

FIG. 4 depicts steps performed in a particular order for the purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

At 410, the method 400 includes receiving power from an unpowered state. In other words, 410 may include powering on the appliance (and controller thereof) from an unpowered state. The entire appliance or controller may be required to first be in the unpowered state and then receive power (e.g., an electrical current or voltage, as would be necessary for operation). This may occur, for instance, when plugging in or connecting the appliance to a power source, such as a municipal power network or generator. Optionally, a previous programming input may be provided (e.g., at a manufacturing facility) to trigger detection of a first-in-time power reception. Thus, 410 may be required to follow such a programming input (e.g., within the memory of the controller).

At 420, the method 400 includes determining an appliance relocation. Generally, 420 provides for identifying if or when the appliance has been relocated or is otherwise likely to have been exposed to a new or modified environment (e.g., to warrant recalibration). In some embodiments, 420 includes detecting one or more relocation markers. For example, the relocation marker(s) may include an unrecorded IP address, network name, geolocation coordinate address, or power-reception instance.

In some embodiments, the method 400 further includes connecting to a network device (e.g., router) having a programmed IP address. Such a connection generally requires reception of power and may thus follow 410. Optionally, a user may confirm the appropriate network device or enter credentials for the same (e.g., at the control panel or a separate user device, as is understood). After a connection is made, the appliance may be able to read and record (e.g., temporarily) the programmed IP address of the network device. This programmed IP address may be compared to a slot or list of previously read IP addresses (i.e., IP addresses of network devices to which the appliance has previously connected). From the comparison, the appliance may be able to determine if the appliance has previously recorded the programmed IP address of the network device. If the programmed IP address is not previously recorded (i.e., held within the previously read IP-address slot or list), the programmed IP address may be identified as an unrecorded IP address. Thus, it may be determined that the appliance has not previously connected to the network device. Based on the determination that programmed IP address is an unrecorded IP address, 420 may include determining that the appliance is likely to be in a new location. In other words, 420 may include determining the programmed IP address is an unrecorded IP address In additional or alternative embodiments, the method 400 further includes connecting to a network device (e.g., router) having a programmed network name. Such a connection generally requires reception of power and may thus follow 410. Optionally, a user may confirm the appropriate network device or enter credentials for the same (e.g., at the control panel or a separate user device, as is understood). After a connection is made, the appliance may be able to read and record (e.g., temporarily) the network name of the network device. This network name may be compared to a slot or list of previously read network names (i.e., network names of network devices to which the appliance has previously connected). From the comparison, the appliance may be able to determine if the appliance has previously recorded the network name of the network device. If the programmed network name is not previously recorded (i.e., held within the previously read network-name slot or list), the network name may be identified as an unrecorded network name. Thus, it may be determined that the appliance has not previously connected to the network device. Based on the determination that programmed network name is an unrecorded network name, 420 may include determining that the appliance is likely to be in a new location. In other words, 420 may include determining the programmed name is an unrecorded network name.

In further additional or alternative embodiments, the method 400 further includes receiving a geolocation (e.g., GPS) signal corresponding to the physical position or address of the appliance. Reception of such a signal generally requires reception of power and may thus follow 410. Optionally, a user may confirm the appropriate geolocation (e.g., at the control panel or a separate user device, as is understood). After a connection is made, the appliance may be able to read and record (e.g., temporarily) the geolocation (e.g., coordinate address corresponding to the geolocation signal) of the appliance. This geolocation coordinate address may be compared to a slot or list of previously detected geolocations (i.e., coordinate address that the appliance has previously detected). From the comparison, the appliance may be able to determine if the appliance has previously recorded the geolocation coordinate address. If the geolocation coordinate address is not previously recorded (i.e., held within the previously read location slot or list), the geolocation coordinate address may be identified as an unrecorded geolocation. Thus, it may be determined that the appliance has not previously been located at the unrecorded geolocation. Based on the determination that the geolocation coordinate address is an unrecorded geolocation, 420 may include determining that the appliance is likely to be in a new location. In other words, 420 may include determining the geolocation signal corresponds to or is an unrecorded geolocation.

In yet further additional or alternative embodiments, 420 includes determining 410 is a first-in-time power reception post-assembly. In other words, it may be determined that 410 is the first time appliance has received powered after being assembled. For instance, a counter may be provided on the controller to mark or record each instance in which the appliance receives power (e.g., for a set period of time). If the counter is at 0 prior to 410, or 410 moves the counter to 1, it may be determined that the appliance has not previously received power. In turn, 410 is a first-in-time power reception after the assembly process (e.g., including any testing or programming steps taken during assembly).

As would be understood, the determined appliance relocation may prompt or be indicated, for instance, via a displayed message or projected alert (e.g., at the control panel) as part of 400. Such an indication may draw a user's attention or prompt interaction.

At 430, the method 400 includes receiving a user input, such as a single user input signal following 420. For instance, 430 may include receiving a calibration-initiation command. In other words, a command to initiate a calibration routine may be received from the user. In this regard, the user may initiate a calibration routine after receiving a prompt following. As would be understood, such commands may be received from or in response to a user engaging with the control panel, such as at a button or dial thereof. Notably, receiving the user input signal (may simplify the process for prompting a calibration routine, which might otherwise require multiple button presses (e.g., key inputs), specialized tools, or advanced knowledge.

At 440, the method 400 includes directing a calibration routine. The calibration routine or prompting of the same may follow and be based 420. Optionally, 440 may further be in response to or contingent on 430. Generally, the calibration routine includes predetermined sequences or steps for activating one or more electronic components (e.g., valves, motors, heater elements, sensors, etc.). Specifically, 440 may include running a calibration sequence or algorithm, and causes at least one electronic (e.g., electromechanical) component of the appliance to be operated. For example, the mechanical component may be a motor (e.g., motor coupled to the wash basket), a fan, one or more water valves, a pump assembly or motor, among other possible example mechanical components of the appliance. Also, operating the electronic component includes changing a physical status of the component, e.g., a speed, position, etc. of the component, such as accelerating the motor, fan, etc., e.g., from a zero starting speed, opening a valve, or other changes in the physical state of one or more mechanical components of the washing machine appliance.

In some embodiments, the calibration routine includes a test or check of water-supply or water-treatment features, such as a predetermined valve sequence. Thus, 440 may include opening a water valve and closing the water value according to the predetermined valve sequence. For instance, the water valves may be opened (e.g., for a predetermined period of time or until a set volume of water is supplied) before being closed such that a volume of water is supplied to the wash tub. One or more water sensors may then be tested. For instance, testing signal may be transmitted to or received from a temperature sensor, a turbidity sensor, or a pressure sensor.

Testing of the water sensors may confirm the presence or operation of such sensors, generally, or use such reading for one or more further determinations—as would be understood in light of the present disclosure. As an example, a flowrate for water from the water valve(s) may be set (e.g., based on a measured time needed to reach a predetermined pressure within the tub). Thus, 440 may include setting a stored flowrate for the water valve based on the calibration routine. As would be understood, the stored flowrate may then be used to set or adjust various programmed steps or instructions (e.g., for executing a wash cycle or operation, or another operation of the appliance).

As an additional or alternative example, hot and cold water valves may be identified. For instance, 440 may include opening a first water valve and closing the first water valve according to the predetermined valve sequence and measuring a first water temperature within the domestic appliance (e.g., following opening the first water valve). Subsequently, 440 may include opening a second water valve and closing the second water valve according to the predetermined valve sequence and measuring a second water temperature within the domestic appliance (e.g., following opening the second water valve). Based on the measured temperature, 440 may include designating the first water valve as a hot water valve and designating the second water valve as a cold water valve (or vice versa), as would be understood. As would further be understood, the designation of the hot and cold water valves may then be used to set or adjust various programmed steps or instructions (e.g., for executing a wash cycle or operation, or another operation of the appliance).

In optional embodiments, the valve sequence is provided as part of a larger routine as part of the calibration routine, such as a wash routine module to test or check features for treating articles (e.g., during a wash cycle or while a volume of water is present within the wash tub). For instance, a water heating element may be activated (e.g., for a predetermined period of time) before being deactivated to heat the wash chamber or water therein. Additionally or alternatively, a drain pump or pump assembly may be activated (e.g., for a predetermined period of time or until no further water is detected) before being closed such that the volume of water is exhausted from the wash tub. Thus, 440 may include setting a stored drain rate for the pump assembly based on the calibration routine. As would be understood, the stored drain rate may then be used to set or adjust various programmed steps or instructions (e.g., for executing a wash cycle or operation, or another operation of the appliance).

In additional or alternative embodiments, the calibration routine includes a test or check of one or more motor features, such as a motor sequence. Thus, 440 may include activating one or more motors mounted within the cabinet according to the predetermined motor sequence. The motor (e.g., motor coupled to the basket) may be directed to rotate or spin the basket (e.g., for a predetermined period or at a predetermined velocity). While the motor is being directed to rotate, one or more signals may be received to confirm or validate installation of the motor (e.g., confirm the motor is operating as expected or according to one or more predetermined parameters). Optionally, while the basket is rotated, one or more tub sensors (e.g., a measurement device, as described above) may be tested, such as to measure movement of the tub or speed of the basket rotation. Testing of the tub sensors may confirm operation of such sensors, generally, or use such reading for one or more diagnostic decisions—as would be understood in light of the present disclosure. As an example, detected movement from the measurement device (e.g., beyond a predetermined threshold) may indicate one or more packing materials, which may constrain certain elements (e.g., the tub) during shipping, have been removed. Thus, 440 may include setting a packing material state (e.g., as "absent" or, alternatively as "present") for packing material shipped with the domestic appliance based on the detected movement.

In optional embodiments, the motor sequence is provided as part of a larger routine as part of the calibration routine, such as a post-wash routine module to test or check features for maintaining articles after a wash cycle (e.g., to prevent soaking or mildewing). For instance, a fan may be activated to motivate an airflow. Subsequently, the fan may be deactivated. In some embodiments, a lock assembly is tested, such as by being directed to lock a door of the appliance (e.g., for a predetermined period of time or until completion of the calibration routine). As noted above, the motor may be directed to rotate or spin the basket (e.g., for a predetermined period or at a predetermined velocity). While the basket is rotated, one or more tub sensors (e.g., measurement device) may be tested, such as to measure movement of the tub or speed of the basket rotation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance comprising:

a cabinet defining a chamber for the receipt of articles;

a water valve attached to the cabinet in fluid communication within the chamber to selectively flow liquid thereto;

a motor mounted within the cabinet in mechanical communication with the chamber; and a controller in operative communication with the water valve and the motor, the controller being configured to initiate a calibration operation, the calibration operation comprising receiving power from an unpowered state, determining an appliance relocation in response to receiving power from the unpowered state, and directing a calibration routine based on determining the appliance relocation, the calibration routine comprising opening the water valve and closing the water valve according to a predetermined valve sequence or activating a motor mounted within a cabinet of the laundry appliance according to a predetermined motor sequence, wherein the controller comprises a counter configured to record each instance of power reception, and wherein determining the appliance relocation comprises determining the counter exceeds a predetermined value.

2. The laundry appliance of claim 1, wherein the calibration routine comprises setting a stored flowrate for the water valve based on the calibration routine.

3. The laundry appliance of claim 1, wherein the calibration routine comprises validating installation of the motor based on the calibration routine.

4. The laundry appliance of claim 1, wherein the water valve is a first water valve, wherein the calibration routine comprises identifying a hot and cold water valve, wherein the calibration routine further comprises opening the first water valve and closing the first water valve according to the predetermined valve sequence, measuring a first water temperature within the laundry appliance following opening the first water valve, opening a second water valve and closing the second water valve according to the predetermined valve sequence, measuring a second water temperature within the laundry appliance following opening the second water valve, and wherein identifying the hot and cold water valve comprises designating the first water valve as the hot water valve and designating the second water valve as the cold water valve based on the measured first and second water temperatures.

5. The laundry appliance of claim 1, wherein the calibration routine comprises detecting movement at a measurement device within the laundry appliance while activating the motor, and setting a packing material state for packing material shipped with the laundry appliance based on the detected movement.

6. The laundry appliance of claim 1, wherein determining the appliance relocation comprises determining receiving power from the unpowered state is a first-in-time power reception post-assembly.

7. The laundry appliance of claim 1, wherein the calibration operation further comprises connecting to a network device having a programmed IP address following receiving power, and wherein determining the appliance relocation comprises determining the programmed IP address is an unrecorded IP address.

8. The laundry appliance of claim 1, wherein the calibration operation further comprises connecting to a local network having a programmed name following receiving power, wherein determining the appliance relocation comprises determining the programmed name is an unrecorded network name.

9. The laundry appliance of claim 1, wherein the calibration operation further comprises receiving a geolocation signal corresponding to a physical position of the laundry appliance following receiving power, wherein determining the appliance relocation comprises determining the geolocation signal corresponds to an unrecorded geolocation.

10. The laundry appliance of claim 1, wherein the calibration operation further comprises receiving a single user input signal following determining the appliance relocation, wherein directing the calibration routine is in response to the single user input signal.

* * * * *